US008414036B2

(12) United States Patent
Baillia-Prel

(10) Patent No.: US 8,414,036 B2
(45) Date of Patent: Apr. 9, 2013

(54) ANTI-PANIC BAR AND DOOR EQUIPPED THEREWITH

(75) Inventor: Quentin Baillia-Prel, Moulins (FR)

(73) Assignee: JPM SAS, Moulins (FR)

( * ) Notice: Subject to any disclaimer, the term of this patent is extended or adjusted under 35 U.S.C. 154(b) by 0 days.

(21) Appl. No.: 10/588,006

(22) PCT Filed: Feb. 1, 2005

(86) PCT No.: PCT/FR2005/000211

§ 371 (c)(1),
(2), (4) Date: Sep. 20, 2006

(87) PCT Pub. No.: WO2005/075767

PCT Pub. Date: Aug. 18, 2005

(65) Prior Publication Data

US 2007/0170726 A1 Jul. 26, 2007

(30) Foreign Application Priority Data

Feb. 2, 2004 (FR) ..... 04 00960

(51) Int. Cl.
*E05B 65/10* (2006.01)
*E05B 65/00* (2006.01)

(52) U.S. Cl.
USPC ..... 292/92; 292/93; 292/94; 292/DIG. 65

(58) Field of Classification Search ..... 292/92–94, 292/DIG. 65; 70/92
See application file for complete search history.

(56) References Cited

U.S. PATENT DOCUMENTS

| | | | | | |
|---|---|---|---|---|---|
| 943,973 | A | * | 12/1909 | Hope et al. | 292/92 |
| 975,456 | A | * | 11/1910 | Prevost | 292/93 |
| 1,059,555 | A | * | 4/1913 | Money | 292/254 |
| 1,105,252 | A | * | 7/1914 | Carstens | 292/92 |
| 1,564,184 | A | * | 12/1925 | Prinzler | 292/341.17 |
| 1,898,505 | A | * | 2/1933 | Soemer | 292/92 |
| 2,104,618 | A | * | 1/1938 | Hasenfuss | 292/93 |
| 2,111,064 | A | * | 3/1938 | Geske | 292/226 |
| 2,992,846 | A | * | 7/1961 | Schwanz et al. | 292/127 |
| 3,025,095 | A | * | 3/1962 | Christensen | 292/336.3 |
| 3,663,047 | A | * | 5/1972 | Zawadzki | 292/92 |
| 3,969,845 | A | * | 7/1976 | Yulkowski | 49/394 |
| 4,181,335 | A | * | 1/1980 | Thoren | 292/92 |
| 4,312,528 | A | | 1/1982 | Hall et al. | |
| 4,387,917 | A | | 6/1983 | Cocker | |
| 4,986,583 | A | * | 1/1991 | Campbell et al. | 292/336.3 |
| 5,016,927 | A | * | 5/1991 | Toledo | 292/92 |

(Continued)

FOREIGN PATENT DOCUMENTS

EP 1662075 A2 * 5/2006

*Primary Examiner* — Carlos Lugo
(74) *Attorney, Agent, or Firm* — Young & Thompson

(57) ABSTRACT

An anti-panic bar comprises a fixed part (3) with a lock controlling element (5), and a support bar (4) mounted to pivot on the fixed part (3) about a longitudinal axis. In an inactive position, the support bar (4) takes up a position spaced apart from the fixed part (3), and in an active position, the support bar (4) takes up a position closer to the fixed part (3) and also activates the lock controlling element (5). The support bar (4) is an extruded profile binged about the longitudinal axis through a pivot point (40).

28 Claims, 2 Drawing Sheets

U.S. PATENT DOCUMENTS 5,340,171 A * 8/1994 Slaybuagh et al. ..... 292/21
5,769,145 A * 6/1998 Kwatonowski ..... 160/371
6,102,451 A * 8/2000 Merryman ..... 292/92
6,145,897 A * 11/2000 Locher ..... 292/92
6,183,023 B1 2/2001 Yulkowski
6,354,638 B1 * 3/2002 Hoffmann ..... 292/36
6,601,881 B2 * 8/2003 Mandell et al. ..... 292/92
2006/0267356 A1 * 11/2006 Catalano ..... 292/336.3

* cited by examiner

Fig.3
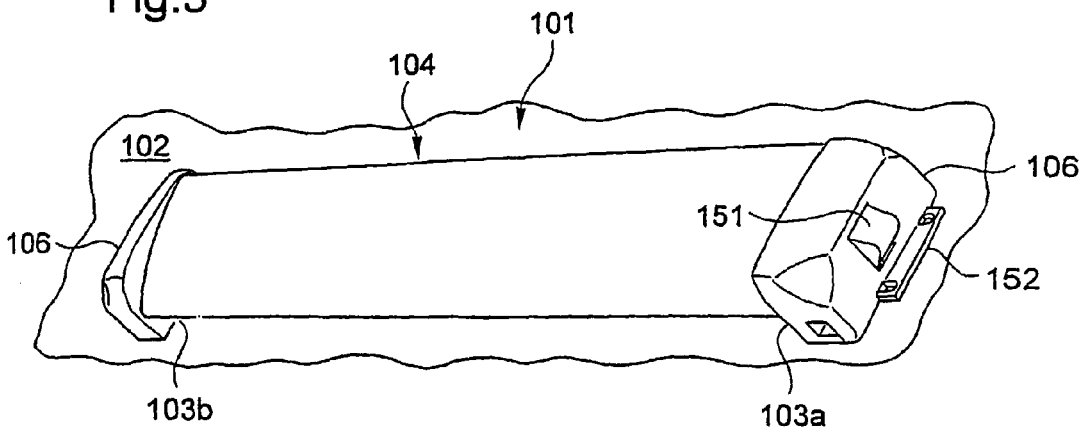
Fig.4
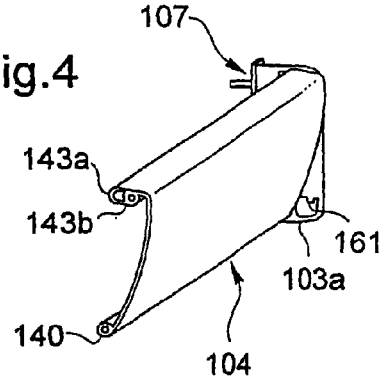
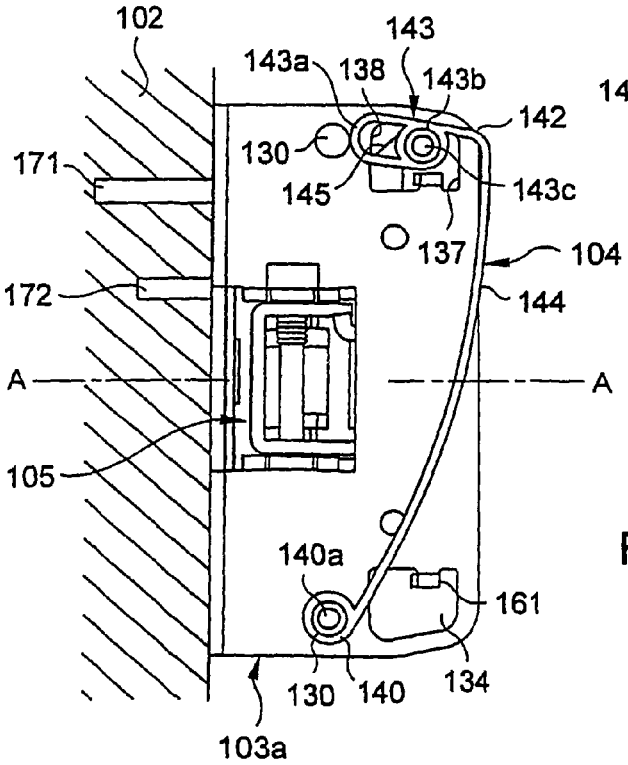
Fig.5

ANTI-PANIC BAR AND DOOR EQUIPPED THEREWITH

The invention relates to a panic bolt and a door equipped there with.

DESCRIPTION OF THE RELATED ART

Prior art panic bolts require many production process steps, which tends to increase their unit cost.

BACKGROUND OF THE INVENTION

The components used also impose a fairly small internal space.

A standard type of panic bolt used on panic doors has a crash bar articulated to a crash bar support.

There are two standard configuration types for articulated panic bolts: a working position and an idle position. In the idle position, the crash bar is in a position remote from the crash bar support. In the working position, which corresponds to opening the door, the crash bar is pushed toward the crash bar support when it is pushed downwardly. Returning it to the idle position necessitates return means to raise the crash bar.

In a different, push-in type of panic bolt, dedicated means are necessary to return the crash bar to a projecting position. This leads to panic bolts of the above kinds being complex and costly.

SUMMARY OF THE INVENTION

The invention consists in a panic bolt that is simple to fabricate and offers greater reliability and a lower production cost.

To this end, the invention proposes a panic bolt including a fixed part having a bolt operating member and a crash bar that is mounted on said fixed part to pivot about a longitudinal axis between an idle position in which said crash bar occupies a position remote from said fixed part and a working position in which said crash bar occupies a position close to said fixed part and in which said crash bar activates said bolt operating member, characterized in that said crash bar comprises a member of profiled section articulated about said longitudinal axis by means of an articulation portion.

Thus the invention proposes an articulated panic bolt whose crash bar comprises a member of profiled section articulated about a longitudinal axis of a fixed part forming the crash bar support. This panic bolt has the advantage of using a crash bar in the form of a member of profiled section, which makes it simple to produce at extremely low cost. Also, using a member of profiled section frees up the space between the crash bar and the crash bar support, which simplifies the panic bolt and also simplifies fitting it.

According to a preferred feature of the invention, the panic bolt includes at least one abutment carried by said fixed part cooperating with at least one stop portion carried by said crash bar, their cooperation delimiting the range of movement in articulation of said crash bar. This limited range of movement controls the cooperation between the crash bar and the bolt operating member, which makes the panic bolt more reliable at the same time as preserving great simplicity of fabrication and fitting.

According to another advantageous feature of the invention, said articulation portion is situated in a lower portion of said crash bar and cooperates with an articulation portion of said fixed part to articulate the member of profiled section constituting said crash bar about said longitudinal axis and said crash bar includes a stop portion situated in an upper portion of said crash bar. Thus the invention proposes an articulated panic bolt whose mechanism is advantageously inverted compared to that of the articulated panic bolts cited above, i.e. a panic bolt in which an upward push is required to move it from the working position to the idle position.

Eliminating the return means produces a panic bolt that is simpler to fit, more economic to produce and more reliable; the return movement may be obtained simply by the effect of gravity.

In a first preferred embodiment of the invention, the fixed part is a member of profiled section extending in the same direction as said crash bar. Using a member of profiled section to form the crash bar support further reduces production costs and further simplifies the fabrication and fitting of this kind of panic bolt.

According to an advantageous feature of the invention, in this first embodiment, said fixed part includes a longitudinal housing which is entered with clearance by a longitudinal edge of the member of profiled section of said crash bar. This feature makes the relationship between the crash bar and the crash bar support more efficient and more reliable.

Said longitudinal housing preferably includes at least one abutment carried by said fixed part cooperating with at least one stop portion carried by said crash bar, their cooperation delimiting the range of movement in articulation of said crash bar. Thus a panic bolt of this kind is easy to fit and extremely easy to manipulate.

According to another advantageous feature of the invention, a plurality of abutments cooperate with one stop portion or one abutment cooperates with a plurality of stop portions. These two features may be combined. There is therefore a real delimitation of the angular freedom of movement at both ends.

According to another advantageous feature of the invention, said crash bar has a curved portion that enters said longitudinal housing via an opening at which is situated an abutment formed by a free end of said housing, and said stop portion is a rim at the end of said curved portion.

According to another advantageous feature of the invention, said fixed part includes longitudinal ribs adapted to receive said bolt operating member. The bolt operating member is therefore held optimally at the level of the crash bar support, at the same time as remaining very easy to fit.

According to another advantageous feature of the invention, said crash bar has a longitudinal articulation bead in the vicinity of a longitudinal edge of the member of profiled section that cooperates with a slotted tube of the member of profiled section constituting said fixed part to articulate said crash bar about said longitudinal axis. The crash bar is therefore effectively articulated to the crash bar support and the resulting panic bolt is easy to manipulate.

According to another preferred embodiment of the invention, said fixed part includes two lateral plates between which said crash bar is situated. Using two plates to form the crash bar support minimizes the space used by the crash bar support and the material used to produce it.

According to an advantageous feature of this other embodiment of the invention, each of said plates includes at least one abutment cooperating with at least one stop portion of said crash bar, their cooperation delimiting the range of movement in articulation of said crash bar. The panic bolt according to the invention is therefore simple to fit and provides good control of the cooperation of the crash bar with the plate.

According to another advantageous feature of the invention, one abutment cooperates with a plurality of stop portions or a plurality of abutments cooperate with one stop portion. There is therefore a real limitation of the angular freedom of movement at both ends.

According to another advantageous feature of the invention, said crash bar has on the member of profiled section a lateral projection that forms said stop portion, said abutments being formed by edges of a window that is formed in one of said plates and which said lateral projection enters.

Alternatively, the member of profiled section constituting said crash bar has two longitudinal ends each of which includes a lateral projection forming a stop portion and said abutments are formed by edges of a window that is formed in each of said plates and which one of said two lateral projections enters. The crash bar can therefore move without being distorted by excessive torsion.

According to another advantageous feature of the invention, at the end of one longitudinal edge of the member of profiled section constituting said crash bar, said crash bar has a curvature in the shape of a longitudinal hollow cylinder and said crash bar is placed between said plates so that, at each end of said crash bar, said cylinder faces an opening formed in the respective plate, a pin entering said cylinder and said opening at each of said plates to articulate said crash bar about said longitudinal axis. The crash bar is therefore articulated to the crash bar support effectively and the resulting panic bolt is easy to manipulate.

According to another advantageous feature of the invention, each of said plates is substantially symmetrical with respect to a median longitudinal plane of the panic bolt. According to another advantageous feature of the invention, said plates are substantially symmetrical to each other with respect to a median transverse plane of the panic bolt. These features greatly facilitate the fabrication of the plates and reduce costs by offering the possibility of economies of scale and by delaying the differentiation of the plates on the production line.

According to another advantageous feature of the invention, said plates include fixing means for fixing them to a support.

According to another advantageous feature of the invention, the panic bolt includes lateral shells adapted to be fixed to said fixed part. These lateral shells are situated at the ends of the crash bar and provide a pleasing esthetic appearance at the same time as protecting the mechanisms that connect the crash bar to the crash bar support.

According to another advantageous feature of the invention, each of said lateral shells is substantially symmetrical with respect to a median longitudinal plane of the panic bolt. According to another advantageous feature of the invention, said lateral shells are substantially symmetrical to each other with respect to a median transverse plane of the panic bolt. These features greatly facilitate the fabrication of the shells and reduce costs by offering the possibility of economies of scale and by delaying the differentiation of the plates on the production line.

According to another advantageous feature of the invention, the panic bolt includes a bolt on which said bolt operating member acts.

According to another advantageous feature of the invention, the panic bolt includes lateral shells and said bolt passes through one of said lateral shells.

BRIEF DESCRIPTION OF THE DRAWINGS

The explanation of the invention continues next with the following description of one embodiment of the invention, which is given by way of illustrative and nonlimiting example and with reference to the appended drawings, in which:

FIG. 3 is a perspective view of another panic bolt of the invention in which the fixed part includes two lateral plates;

FIG. 4 is an exploded perspective view of the crash bar and of one plate of the FIG. 3 panic bolt; and FIG. 5 is a view in section and in elevation of the FIG. 3 panic bolt at the level of a lateral plate that carries a bolt operating member.

DETAILED DESCRIPTION OF THE PREFERRED EMBODIMENTS

Figure 1:
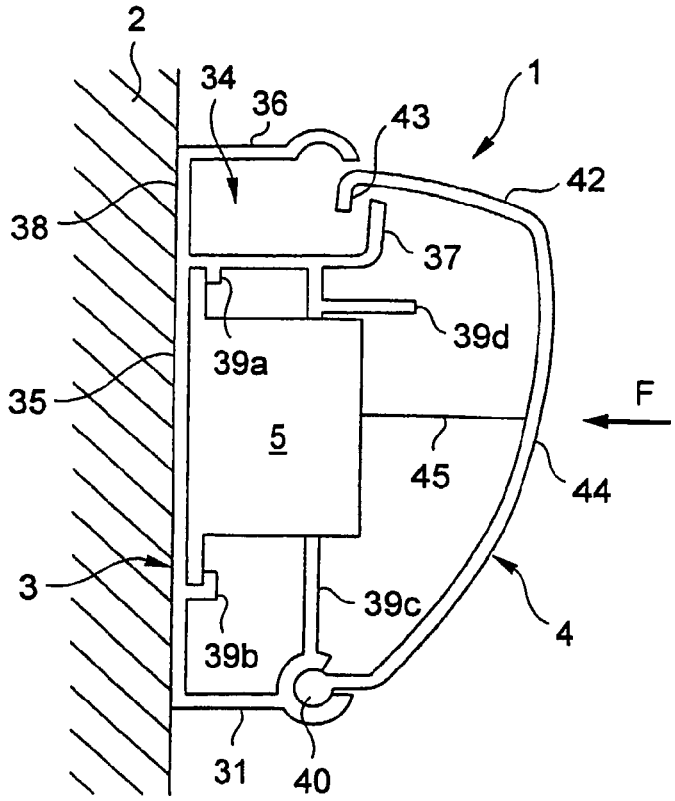
FIG. 1 is a diagrammatic view in section of a panic bolt in which the fixed part is a member of profiled section, showing the panic bolt in an idle position.
Figure 2:
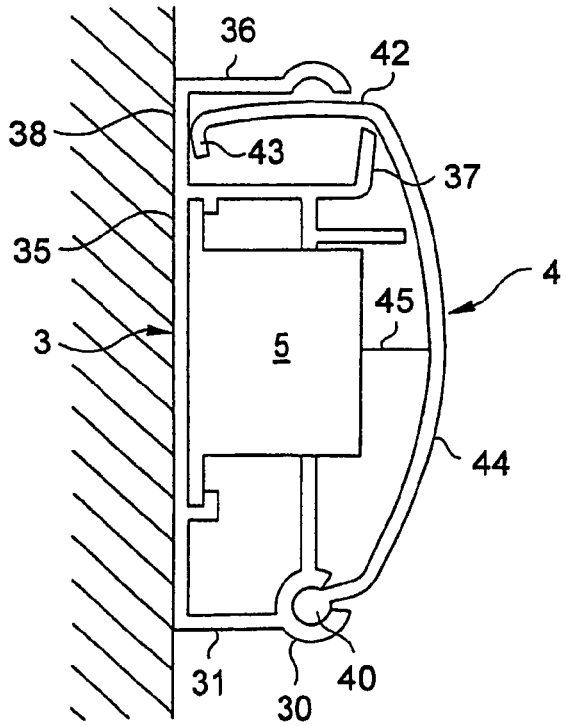
FIG. 2 is a diagrammatic view in section of the FIG. 1 panic bolt in a working position.

Referring to FIGS. 1 and 2, the panic bolt 1 is fixed to a door 2 and includes a fixed part 3 to which a crash bar 4 is articulated.

The fixed part 3 is a metal member of profiled section that extends longitudinally on the door 2.

The fixed part 3 receives a bolt operating member 5 and lateral shells (not shown).

The fixed part 3 is also provided with any appropriate means (not shown) for fixing it to the door 2.

A lower portion of the fixed part 3 includes a slotted tube 30 at the edge of a lower wall 31 that extends the length of the member of profiled section of the fixed part 3. The slotted tube 30 forms a lower longitudinal edge of the fixed part 3.

An upper portion of the fixed part 3 includes a longitudinal upper wall 36. This wall is substantially orthogonal to a bottom 35 of the fixed part 3. The bottom 35 is a longitudinal portion of the section that extends over the door 2 and is connected to the lower wall 31 and to the upper wall 36.

An L-shaped wall orthogonal to the bottom 35 terminates at a rim forming an abutment 37. The bottom 35 forms an abutment 38 facing the abutment 37.

The free space between the L-shaped wall, the abutments 37 and 38 and the upper wall 36 defines a longitudinal housing 34 extending the length of the member of profiled section of the fixed part 3.

Here the crash bar 4 comprises a C-shaped metal member of profiled section extending in a longitudinal direction.

A lower portion of the crash bar 4 includes an articulation bead 40 that forms a longitudinal lower edge of the member of profiled section of the crash bar 4. The articulation bead 40 forms an articulation portion of the crash bar 4 and cooperates with the slotted tube 30.

The section constituting the crash bar 4 also includes an upper portion 42 extended by a rim that forms a stop portion 43 and a maneuvering portion 44 between this upper portion 42 and the articulation bead 40.

The maneuvering portion 44 is a curved longitudinal portion of the member of profiled section of the crash bar 4. This portion 44 is adapted to assume positions in which it is substantially parallel to or at a small angle to the door 2.

As indicated above, the crash bar 4 is articulated to the fixed part 3 by the cooperation of the slotted tube 30 and the articulation bead 40 that enters it.

These two members 30 and 40, which extend along their respective member of profiled sections, define a longitudinal articulation axis about which the crash bar 4 can pivot.

The range of movement of the crash bar 4 is limited by the cooperation of the stop portion 43 with the abutments 37 and 38. To this end, the upper portion 42 enters the longitudinal housing 34 via a slot between the upper wall 36 and the abutment 37. The width of this slot is slightly greater than the thickness of the upper portion 42.

The stop portion 43, which forms a rim, is therefore mobile only between the abutment 37 and the abutment 38. The restricted freedom of movement of the stop portion 43 limits the range of movement of this portion of the crash bar 4.

The bolt operating member 5 is mounted in the fixed part 3 by means of longitudinal ribs 39*a*, 39*b*, 39*c* and 39*d* and is connected to the crash bar 4 by appropriate means known in the art, such as a link shown diagrammatically by the line 45.

The crash bar 4 represented in FIGS. 1 and 2 is mounted so that, regardless of its position, the force of gravity tends to move the crash bar 4 away from the bottom 35 of the fixed part 3.

When the panic bolt 1 is in the idle position (FIG. 1), the stop portion 42 of the crash bar 4 is at a position farthest away from the bottom 35. In this position, the stop portion 43 is butted up against the abutment 37 because of the weight of the crash bar 4.

The panic bolt 1 assumes its working position if a user applies sufficient pressure to the maneuvering portion 44 in the direction of the arrow F to overcome the weight of the crash bar 4.

When the panic bolt 1 is in its working position (FIG. 2), the stop portion 43 of the crash bar 4 is in a position closest to the bottom 35. In this position, the stop portion 43 is abutted against the abutment 38.

Because of the connection between the bolt operating member 5 and the crash bar 4, the movement from the idle position to the working position activates the bolt operating member 5.

Activation of the bolt operating member 5 actuates a bolt which passes through one of the two lateral shells and cooperates with a keeper.

The bolt, the keeper and the lateral shells are not shown here to simplify the drawings.

The return movement from the working position to the idle position is effected by releasing the pressure on the crash bar 4. Gravity is then the only force acting on the crash bar 4, which resumes the idle position.

Another embodiment of the panic bolt 1 described above is described next with reference to FIGS. 3 to 5. Components similar to those described above are designated by the same reference numbers increased by 100.

As is apparent in FIGS. 3, 4 and 5, the panic bolt 101 is fixed to a door 102 and includes fixed parts 103*a* and 103*b* and a crash bar 104.

Here the fixed part 103 includes two plates 103*a* and 103*b*.

Each plate 103*a*, 103*b* includes two openings 130 and two windows 134 symmetrical with respect to a median longitudinal plane AA of the panic bolt 101. Each plate also includes means 107 for fixing it to the door 102.

Each window 134 has two lateral edges forming abutments 137 and 138 and, in this embodiment, a lug 161 situated on a transverse rim.

Here the crash bar 104 is a C-shaped metal member of profiled section. This member of profiled section has a curved longitudinal articulation edge 140, an upper portion 142 extended by a tube portion, and a maneuvering portion 144 between the curved longitudinal edge 140 and the upper portion 142.

The longitudinal edge 140 is curved to form a tube that forms an articulation portion of the crash bar 104.

A projection at each longitudinal end of the tube portion of the crash bar 104 forms a stop portion 143.

The tube portion has a U-shaped portion 143*a* connected by the branches of the U-shape to a hollow cylindrical portion 143*b*. A pin 143*c* extends partially into the hollow cylindrical portion 143*b*. The pin 143*c* forms the projection from the tube portion that forms the stop portion 143 at each end of the crash bar 104. Here the hollow cylindrical portion 143*b* and the articulation edge 140 have the same inside diameter.

A transfer member 145 is formed by an arm positioned along an external face of the plate 103*a*.

The transfer member 145 has a portion accessible through one of the windows 134 in the plate 103*a*. The transfer member 145 has an opening here of the same diameter as the openings 130. The stop portion 143 enters this opening through the window 134 and thus connects the crash bar 104 to the transfer member 145. On the opposite side, the transfer member 145 is connected to a bolt operating member 105 mounted on the plate 103*a*.

The crash bar 104 is articulated between the two plates 103*a* and 103*b*. To this end, a pin 140*a* in a lower portion of each plate 103*a* and 103*b* penetrates the curved edge 140 and the opening 130.

The crash bar 104 is therefore articulated about a longitudinal axis that is parallel to the curved edge 140 and passes through the center of the two openings 130 that the pins 140*a* enter.

The range of movement in articulation of the crash bar 104 is limited by the cooperation of the stop portion 143 with the edges of the window 134 in the upper portion of each of the plates 103*a*, 103*b*.

More precisely, it is the stopping of the movement of the stop portion 143 by the abutments 137 and 138 that limits the range of movement of the crash bar 104.

In a simplified variant, not shown, there is only one projection cooperating with only one window at only one end of the crash bar.

Each plate 103*a* and 103*b* can receive a lateral shell 106 that is fixed to the plate 103*a*, 103*b* by the lug 161 with which each window 134 is provided.

The shell 106 that is carried by the plate 103*a* is pierced so that a bolt 151 is able to cooperate with an exterior keeper 152 when acted on by the bolt operating member 105.

The two plates 103*a*, 103*b* are symmetrical with respect to a median longitudinal plane AA of the panic bolt 101. The plates 103*a*, 103*b* are also symmetrical to each other with respect to a median transverse plane of the panic bolt. The shells 106 have the same features of symmetry as the plates 103*a*, 103*b*.

The panic bolt 101 is secured to the door 102 by fixing means 107 that include rods 171 and 172.

This embodiment of the invention operates in substantially the same way as the first embodiment described above.

When the panic bolt 101 is idle, the crash bar 104 is fully retracted by the force of gravity and is held in position by virtue of the stop portion 143 bearing on the abutment 137.

Sufficient pressure on the maneuvering portion 144 and directed toward the door 102 causes the crash bar 104 to pivot about the articulation formed by the pin 140*a*, the opening 130 and the edge 140. This pivoting causes the stop portion 143 to move relative to the window 134.

The stop portion 143 is attached to the transfer member 145 and therefore entrains the transfer member 145 with it when it moves, until it comes into contact with the abutment 138. The movement of the transfer member 145 activates the bolt operating member 105.

When the pressure on the crash bar 104 is released, its weight causes the panic bolt to return to its idle position.

The invention should not be regarded as limited to the embodiments described above.

In particular a variant of either embodiment may be envisaged in which the articulation of the crash bar to the fixed part is in an upper portion of the panic bolt, the return movement from the working position to the idle position being achieved by conventional means (in particular by springs).

Embodiments may also be envisaged in which an abutment on the fixed part cooperates with a plurality of stop portions of the crash bar. For example, one such portion could be situated at the end of the upper portion of the crash bar. The other portion could be formed by a longitudinal rib of the maneuvering portion and limit the stroke of the crash bar by virtue of being stopped by the abutment.

Other embodiments may be considered in which the stop portion is a rib situated substantially in the middle of the maneuvering portion and abutting against an extension of the bolt operating member.

Note that the member of profiled sections are of metal or of synthetic material, such as PVC, aluminum, polymethylmethacrylate, polyamides or any other material suitable for producing profiled-section members.

The invention claimed is:

1. A panic bar assembly configured to be fixed to a door, comprising:

a fixed part configured to be affixed to the door;

a bolt operating member;

a bolt on which said bolt operating member acts; and a crash bar comprising a member made of a one-piece longitudinally extending profiled section having a length in a longitudinal length direction and a width that is shorter than said length, and having a first elongated edge portion and a second elongated edge portion that are spaced from each other in said width direction and that both extend along said length direction, said member of longitudinally extending profiled section mounted on said fixed part to pivot about a longitudinal axis extending along said length direction and located at the first elongated edge portion between an idle angular configuration where the second elongated edge portion is remote from the door and a working angular configuration where the second elongated edge portion is close to the door, said crash bar being configured to activate said bolt operating member in said working configuration, wherein said fixed part includes an abutment configured to cooperate with a stop portion carried by said crash bar to delimit a range of pivot movement of said member of longitudinally extending profiled section, the stop portion being located at said second elongated edge portion, and wherein said member of longitudinally extending profiled section comprises a maneuvering portion between the longitudinal axis and said stop portion.

2. The panic bar assembly according to claim 1, wherein said longitudinal axis is situated in a lower portion of said member of longitudinally extending profiled section, and said member of longitudinally extending profiled section includes said stop portion situated in an upper portion of said member of longitudinally extending profiled section.

3. The panic bar assembly according to claim 1, wherein the member of longitudinally extending profiled section of said crash bar is a first profiled member, and the fixed part comprises a second profiled member of longitudinally extending profiled section.

4. The panic bar assembly according to claim 3, wherein said second profiled member includes a longitudinal housing which is entered with clearance by a longitudinal edge of the first profiled member, said longitudinal edge of the first profiled member entering said longitudinal housing via a slot formed in said longitudinal housing.

5. The panic bar assembly according to claim 3, wherein said first profiled member has a curved portion at the opposite second elongated edge portion, and said stop portion is a rim at the end of said curved portion.

6. The panic bar assembly according to claim 5, wherein a second abutment is made of a wall of said fixed part.

7. The panic bar assembly according to claim 3, wherein said second profiled member includes longitudinal ribs adapted to receive said bolt operating member.

8. The panic bar assembly according to claim 3, wherein said first profiled member has a longitudinal articulation bead in the vicinity of a longitudinal edge of the first profiled member, said articulation bead being configured to cooperate with a slotted tube of the second profiled member to articulate said first profiled member about said longitudinal axis.

9. The panic bar assembly according to claim 1, wherein said fixed part includes two lateral plates between which said crash bar is situated, and wherein each of said plates includes at least one abutment configured to cooperate with at least one stop portion of said crash bar, a cooperation between the at least one abutment and the at least one stop portion delimiting the range of movement in articulation of said crash bar.

10. The panic bar assembly according to claim 9, wherein said crash bar has on the member of longitudinally extending profiled section of said crash bar a lateral projection that forms said stop portion , said abutments being formed by edges of a window that is formed in one of said plates and which said lateral projection enters.

11. The panic bar assembly according to claim 10, wherein the member of longitudinally extending profiled section of said crash bar has two longitudinal ends each of which has a lateral projection forming a stop portion and said abutments are formed by edges of a window that is formed in each of said plates and which one of said two lateral projections enters.

12. The panic bar assembly according to claim 9, wherein, at the end of one longitudinal edge of the member longitudinally extending of profiled section of said crash bar, said crash bar has a curvature in the shape of a longitudinal hollow cylinder and said crash bar is placed between said plates so that, at each end of said crash bar, said cylinder faces an opening formed in the respective plate, a pin entering said cylinder and said opening at each of said plates to articulate said crash bar about said longitudinal axis.

13. The panic bar assembly according to claim 9, wherein each of said plates is substantially symmetrical with respect to a median longitudinal plane (AA) of the panic bar.

14. The panic bar assembly according to claim 9, wherein said plates are substantially symmetrical to each other with respect to a median transverse plane of the panic bar.

15. The panic bar assembly according to claim 9, wherein said plates include fixing means for fixing them to a support.

16. The panic bar assembly according to claim 1, further comprising:

lateral shells adapted to be fixed to said fixed part.

17. The panic bar assembly according to claim 16, wherein each of said lateral shells is substantially symmetrical with respect to a median longitudinal plane (AA) of the panic bar.

18. The panic bar assembly according to claim 16, wherein said lateral shells are substantially symmetrical to each other with respect to a median transverse plane of the panic bar.

19. The panic bar assembly according to claim 1, further comprising:

lateral shells and said bolt passes through one of said lateral shells.

20. The panic bar assembly according to claim 1, wherein the first profiled member is connected to the bolt operating member by a transfer member.

21. The panic bar assembly according to claim 1, wherein said stop portion delimits a range of motion in a direction of the working configuration.

22. The panic bar assembly according to claim 1, wherein said stop portion delimits a range of motion in a direction of the idle configuration.

23. The panic bar assembly according to claim 1, wherein the maneuvering portion is curved with an outer face configured to receive operative pressure from a user.

24. The panic bar assembly according to claim 1, wherein the longitudinally extending profiled section has a main body, and a first arm extending from one end of the main body, the stop portion extending from the end of the first arm.

25. The panic bar assembly according to claim 1, wherein said stop portion delimits a range of motion in a direction of the working configuration, and wherein said stop portion further delimits a range of motion in a direction of the idle configuration.

26. The panic bar assembly according to claim 1, wherein the crash bar is configured to move from the idle configuration to the configuration position upon an operational application of pressure upon the maneuvering portion, and further configured to return from the working configuration to the idle configuration upon release of said operational application of pressure.

27. A door comprising a bolt and a panic bar assembly configured to be fixed on the door, the panic bar comprising:

a fixed part configured to be affixed to the door;

a bolt operating member;

a bolt on which said bolt operating member acts; and a crash bar comprising an extruded profile made of a one-piece longitudinally extending profiled section, having a length in a longitudinal length direction and a width that is shorter than said length, and having a first elongated edge portion and a second elongated edge portion that are spaced from each other in said width direction, the first elongated edge portion of said member of longitudinally extending profiled section being pivotably mounted on said fixed part to pivot about a longitudinal axis that extends in the length direction and that is located at the first elongated edge portion, such that said member of longitudinally extending profiled section is rotatable between an idle angular configuration where the second elongated edge portion is remote from the door and a working angular configuration where the second elongated edge portion is close to the door, said crash bar being configured, upon an operational application of pressure thereon for moving the crash bar from said idle configuration to said working configuration, to activate said bolt operating member, and further configured so that the crash bar returns to the idle configuration from the working configuration upon a release of said pressure, said fixed part including one abutment configured to cooperate with one stop portion carried by said crash bar to delimit a range of pivot movement of said extruded profile about said longitudinal axis, the stop portion being located at said second elongated edge portion, and said one-piece longitudinally extending profiled section comprising a maneuvering portion between the longitudinal axis and said stop portion.

28. A panic bar assembly configured to be fixed to a door, comprising:

a fixed part configured to be affixed to the door, the fixed part having a first side and an opposite second side;

a bolt operating member;

a bolt on which said bolt operating member acts; and a crash bar comprising a member made of a one-piece longitudinally extending profiled section with a first elongated edge portion and an opposite second elongated edge portion, the first elongated edge portion of said member of longitudinally extending profiled section being pivotably mounted on the first side of said fixed part to pivot about a longitudinal axis that is located at the first elongated edge portion and extends along the first side of said fixed part , such that said member of longitudinally extending profiled section is rotatable between an idle angular configuration where the second elongated edge portion is remote from the door and a working angular configuration where the second elongated edge portion is close to the door, said crash bar being configured to activate said bolt operating member in said working configuration, wherein the second side of said fixed part includes an abutment configured to cooperate with a stop portion carried by said crash bar to delimit a range of pivot movement of said member of longitudinally extending profiled section about said longitudinal axis, the stop portion being located at said second elongated edge portion, and wherein said member of longitudinally extending profiled section comprises a maneuvering portion between the longitudinal axis and said stop portion.

* * * * *

UNITED STATES PATENT AND TRADEMARK OFFICE

CERTIFICATE OF CORRECTION

PATENT NO. : 8,414,036 B2
APPLICATION NO. : 10/588006
DATED : April 9, 2013
INVENTOR(S) : Quentin Baillia-Prel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 141 days.

Signed and Sealed this
Fourteenth Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,414,036 B2
APPLICATION NO. : 10/588006
DATED : April 9, 2013
INVENTOR(S) : Quentin Baillia-Prel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 479 days.

Signed and Sealed this
First Day of September, 2015

Michelle K. Lee

Michelle K. Lee
*Director of the United States Patent and Trademark Office*